United States Patent [19]

Schroder

[11] Patent Number: 4,869,348

[45] Date of Patent: Sep. 26, 1989

[54] GROUP CONTROL FOR ELEVATORS WITH IMMEDIATE ALLOCATION OF CALLS OF DESTINATION

[75] Inventor: Joris Schroder, Lucerne, Switzerland

[73] Assignee: Inventio AG, Switzerland

[21] Appl. No.: 232,445

[22] Filed: Aug. 15, 1988

[30] Foreign Application Priority Data

Sep. 24, 1987 [CH] Switzerland ..... 3698/87

[51] Int. Cl.[4] ..... B66B 1/18

[52] U.S. Cl. ..... 187/127

[58] Field of Search ..... 187/121, 124, 127

[56] References Cited

U.S. PATENT DOCUMENTS

| | | | |
|---|---|---|---|
| 4,411,337 | 10/1983 | Schroder et al. | 187/127 |
| 4,492,288 | 1/1985 | Schroder | 187/127 |
| 4,555,000 | 11/1985 | Umeda | 187/127 |
| 4,638,889 | 1/1987 | Ludwig et al. | 187/127 |
| 4,718,520 | 1/1988 | Schroder | 187/127 |

FOREIGN PATENT DOCUMENTS

| | | |
|---|---|---|
| 0032213 | 7/1981 | European Pat. Off. . |
| 0050304 | 6/1984 | European Pat. Off. . |
| 0026406 | 8/1984 | European Pat. Off. . |
| 0050305 | 9/1984 | European Pat. Off. . |
| 0062141 | 4/1985 | European Pat. Off. . |
| 0246395 | 11/1987 | European Pat. Off. . |

*Primary Examiner*—William M. Shoop, Jr.
*Assistant Examiner*—W. E. Duncanson, Jr.
*Attorney, Agent, or Firm*—Marshall & Melhorn

[57] ABSTRACT

A group control for an elevator system, in which it is possible to assign a newly entered floor call to a car for the first time, immediately and finally, includes a computer and a comparator circuit for calculating servicing costs and assigning the call to the car with the lowest cost during a comparison cycle. The floor call generates an entry floor signal which is stored in a floor call memory and an assignment memory for the assigned car. Storage cells of the assignment memory and the floor call memory are linked to each other by way of an automatic holding circuit that prevents reassignment of the floor call during subsequent comparison cycles.

6 Claims, 2 Drawing Sheets

GROUP CONTROL FOR ELEVATORS WITH IMMEDIATE ALLOCATION OF CALLS OF DESTINATION

BACKGROUND OF THE INVENTION

The invention relates in general to a group control for elevators and, in particular, to a group control with immediate allocation of calls of destination.

Many known elevator group control systems include call registering devices arranged on the floors, by means of which calls for desired floors of destination can be entered. The entered calls are stored in floor and car call memories assigned to the elevators of the group where a call characterizing the entry floor is stored in the floor call memory and the calls characterizing the destination floors are stored in the car call register memory. Selectors assigned to each elevator of the group indicate the floor of a possible stop. First and second scanners are assigned to each elevator of the group. The first scanner operates during a cost of operation calculation cycle to store for each floor the costs in a cost memory. The second scanner operates during a cost comparison cycle of the costs for all elevators by means of which the entered call is assigned to the car of the elevator group which exhibits the lowest operating costs.

Such a group control is shown in the European patent application No. EP-A 0 246 395 where the assignments of the cars to the entered calls can be optimized in time. The car call memory of an elevator of this group control consists of a first memory containing assigned destination floor calls and additional memories assigned to the floors, in which the desired floor calls entered at the respective floors, but not yet assigned to a car, are stored. A device, by means of which the entered calls are assigned to the cars of the elevator group, includes a computer in the form of a microprocessor and a comparator device. The computer calculates at each floor, during a scanning cycle of a first scanner, from at least the distance between the floor and the car position indicated by a selector, intermediate stops to be expected within this distance and the load in the car, a sum proportional to the time losses of waiting passengers at the floors and in the car. If the first scanners encounter a not yet assigned floor call, then the calls entered at this floor for desired floors of destination, stored in the further memories of the car call memory, are also taken into account. A sum proportional to the new floor calls is therefore determined and a total sum is formed. This total sum, also termed cost of operation, is stored in a cost memory by floor. During a scanning cycle of a second scanner, the operating costs of all elevators are compared with each other by means of the comparator device. An assignment command is stored in an assignment register of the elevator with the lowest operating cost, which designates that floor to which the respective car is optimally assigned in time.

Immediately after the entry of a call for a desired floor of destination, the cost of operation is calculated in this known control. By means of the subsequent comparison, the immediate assignment of the call with the most favorable cost of operation will take place. However, with changes in the traffic situation and corresponding recalculation of the operating costs, other comparative results could arise and a call assigned for the first time to a car can be assigned to another car if it had not yet been transferred to the drive control of the corresponding elevator. By this mode of operation, difficulties can arise for passengers waiting for a car on a floor, as it is not possible to signal to them in time an identification of a car assigned at the last moment.

SUMMARY OF THE INVENTION

It is therefore the aim of the present invention to create a group control according to the superimposed concept, in which the call assignment process makes possible a punctual indication of the assigned car. This problem is solved by an automatic holding circuit which is provided for each elevator, which has the effect that a first-time assigned call remains assigned to a car until it is taken over by the respective drive control.

The advantages realized by the invention are that immediately after the first-time assignment of a call, the respective car can be identified so that enough time remains for the passengers waiting at a floor to recognize the indication and to move in time to the signalled elevator.

Upon entry of a call at a floor, an entry floor call signal is stored in a floor call memory. During a comparison cycle, the floor call is assigned to the car with the lowest cost and stored in an assignment memory. Each of these memories is connected to an automatic holding circuit which responds to the stored floor call by blocking any attempt to reassign the call.

The holding circuit is responsive to the entry floor call stored in the floor call memory and in the assignment memory to generate a data input signal which prevents the resetting of the assignment memory for the associated elevator car during subsequent comparison cycles. In addition, upon assignment of the floor call, the floor call memories of the other cars are reset which prevents the reassignment of the assigned floor call to these cars during subsequent comparison cycles.

DESCRIPTION OF THE PREFERRED EMBODIMENT

Figure 1:
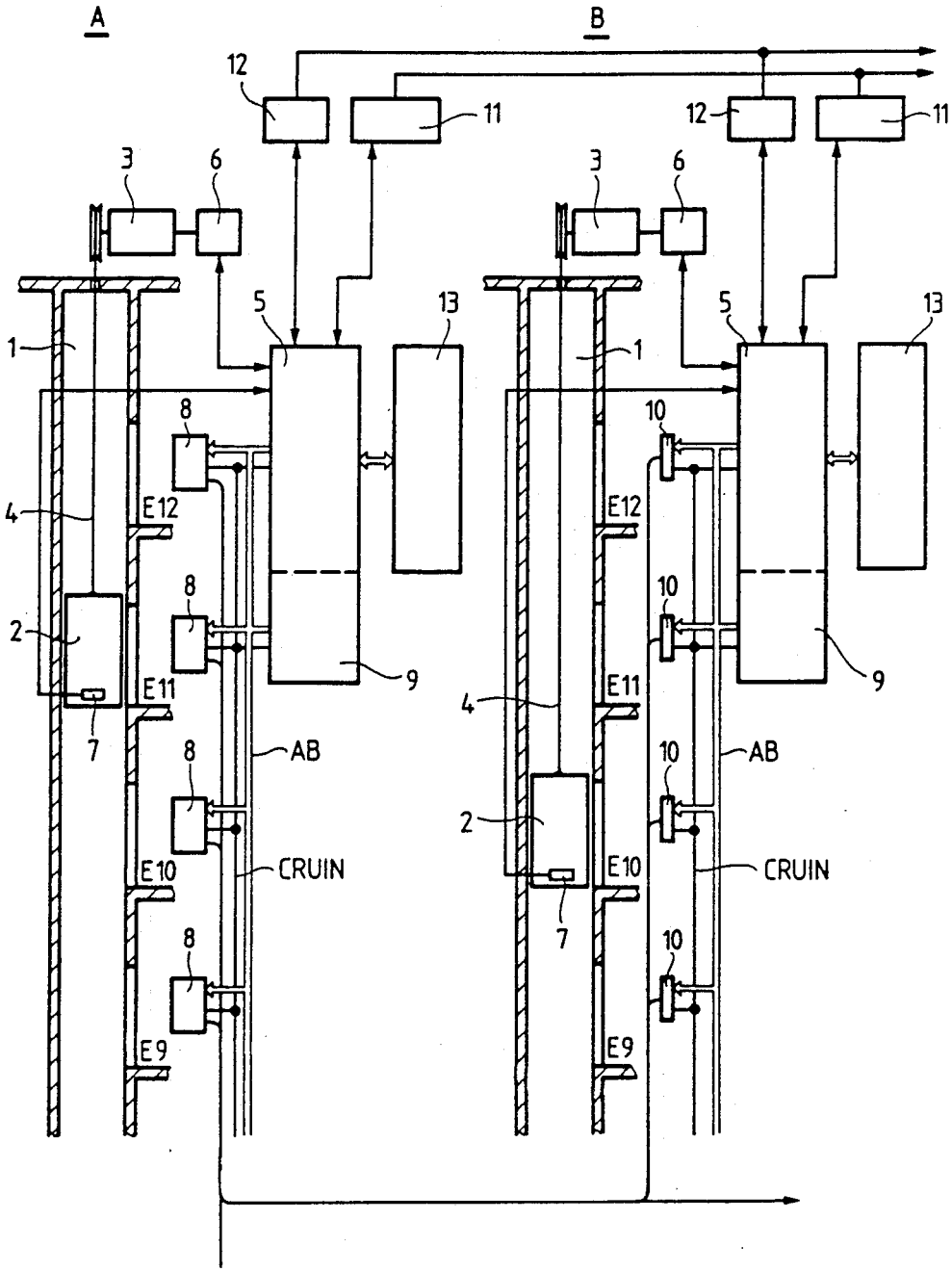
FIG. 1 is a schematic representation of a group control according to the present invention showing two elevators of an elevator group.

Designated with A and B in FIG. 1 are two elevators of an elevator group, each having an elevator car 2 guided in an elevator shaft 1 and driven by a hoist motor 3 by way of a hoisting cable 4. Each elevator car 2 serves, for example, thirteen floors E0 to E12 with only the top four floors being shown. The hoist motor 3 is controlled by a control system, such as is shown in the European Pat. No. EP-B 0 026 406, where the generation of the nominal or set point values, the control functions and the top initiation are realized by means of a microcomputer system 5, which is connected with a control unit 6 of the drive control system. The microcomputer system 5 calculates from elevator parameters a sum corresponding to the average waiting time of all passengers, also termed operating costs, which forms the basis of the call assignment process. The car 2 includes a load measuring device 7, which is likewise connected with the microcomputer system 5, for determining when passengers enter and leave the elevator car.

Provided at the floors are call registering devices 8 in the form of ten key keyboards, by means of which floor calls for trips to desired floors of destination can be entered. The call registering devices 8 are connected with the microcomputer system 5 and an input device 9, shown in the European Pat. No. EP-B 0 062 141, by way of an address bus AB and a data input conductor CRUIN. The call registering devices 8 can be assigned to more than one elevator group. For example, those of the elevator A are in connection by way of coupling elements in the form of multiplexers 10 with the microcomputer system 5 and the input device 9 of the elevator B. The microcomputer system 5 of the individual elevators of the group are connected together by way of a comparison device 11, shown in the European Pat. No. EP-B 0 050 304, and by way of a party-line transfer system 12, shown in the European Pat. No. EP-B 0 050 305, and form, together with the call registering devices 8 and the input devices 9, a group control, which structurally conforms to the group control described in the European patent application No. EP-A 0 246 395.

Designated with 13 is an automatic holding circuit, which is connected with components of the microcomputer system 5 and which will be explained in more detail in the following with the aid of FIG. 3.

Figure 2:
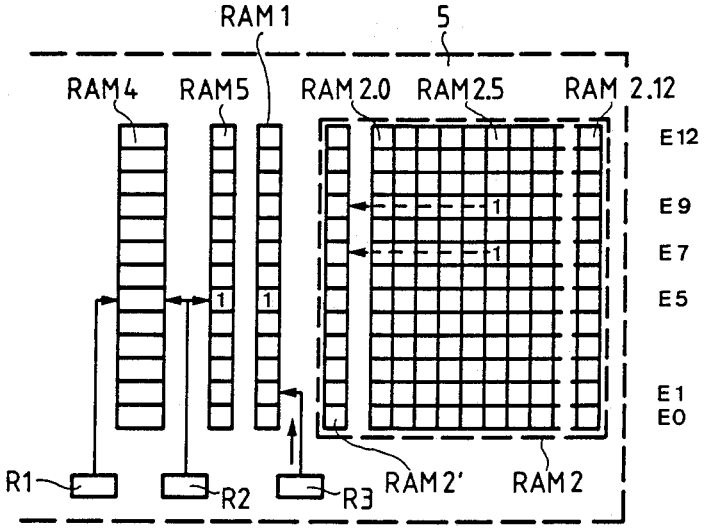
FIG. 2 is a schematic representation of a part of a microcomputer system of the group control according to FIG. 1.

The microcomputer system 5 is partially shown schematically in FIG. 2, and includes, according to the above cited European patent application No. EP-A 0 246 395, a floor call memory RAM1, a car call memory RAM2, a cost memory RAM4, an assignment memory RAM5, a first and second scanner R1 and R2, and a selector R3. The car call memory RAM2 includes a first register RAM2', which has storage locations corresponding to the number of floors, in which already assigned calls are stored. The car call memory RAM2 also includes registers RAM2.0 through RAM2.12, associated with the floors E0 to E12 respectively, which likewise have storage locations corresponding to each of the floors into which the calls entered at the respective floors are transferred which are not yet assigned to a certain car. In this way, the destination floor calls entered on the floor E5 for the floors E7 and E9, according to the example of FIG. 2, are transferred into the register RAM2.5, where at the same time an entry floor call for floor E5 is stored in the floor call memory RAM1. Corresponding to the customary logical symbolism, the stored calls in FIG. 2 are characterized with a "1".

Figure 3:
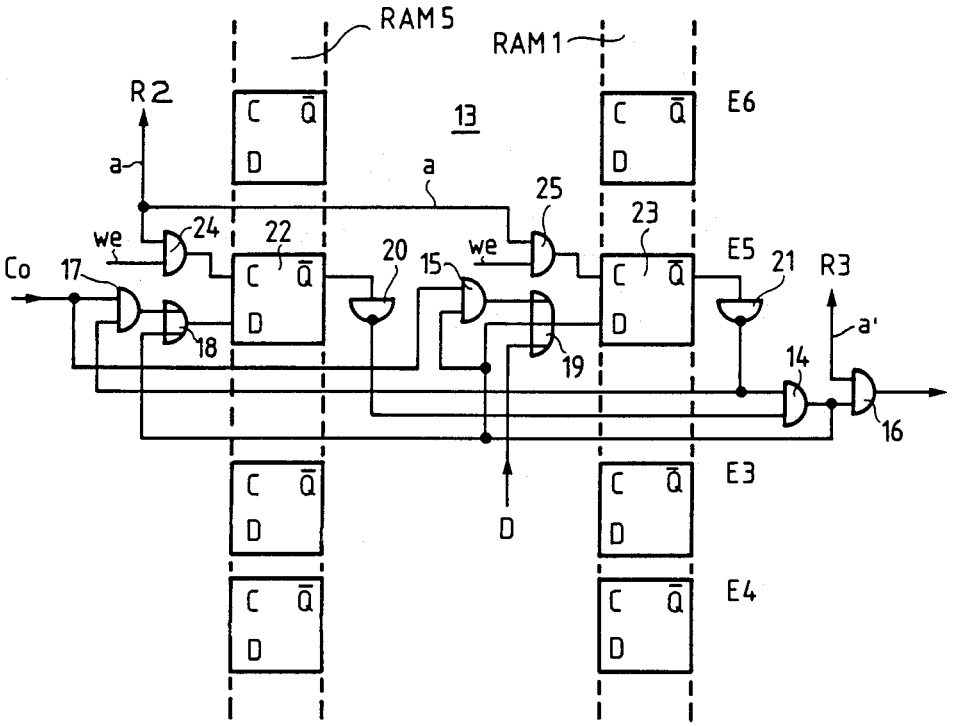
FIG. 3 is a schematic representation of an automatic holding circuit of a group control according to FIG. 1.

According to FIG. 3, the automatic holding circuit 13 consists of a first, second, third and fourth AND-gate 14, 15, 16 and 17 respectively each having two inputs, a first OR-gate 18 having two inputs, a second OR-gate 19 having three inputs and two NOT-gates 20 and 21. Designated with 22 and 23 are storage cells of the assignment memory RAM5 and of the floor call memory RAM1 respectively, the clock inputs "C" of which are connected to outputs of AND-gates 24 and 25 respectively. Each of the AND-gates 24 and 25 has one input connected to a clock signal line "we" and another input connected to an address line "a". The clock signal is generated by the microcomputer 5 and the address line "a" is linked with the second scanner R2 (FIG. 2). The data outputs "Q" of the storage cells 22 and 23 are connected to inputs of the NOT-gates 20 and 21 respectively. The outputs of the NOT-gates 20 and 21 are connected to the inputs of the first AND-gate 14, the output of which is connected to one input of the first OR-gate 18 and one input of the second OR-gate 19. An output of the OR-gate 18 is connected with the data input "D" of the storage cell 22 of the assignment memory RAM5 and an output of the second OR-gate 19 is connected with the data input "D" of the storage cell 23 of the floor call memory RAM1.

The output of the first AND-gate 14 is also connected to a first input of the second AND-gate 15, the output of which is connected to another input of the second OR-gate 19. By way of the third input of the second OR-gate 19, a floor call signal "D" can be fed to the storage cell 23 and, on activation of a write operations (we="1", a="1"), stored in the same. The output of the NOT-gate 21 is connected also with one input of the fourth AND-gate 17, the output of which is connected to the other input of the first OR-gate 18. Supplied to the other inputs of the second and fourth AND-gate 15 and 17 is an assignment signal "Co", which can be generated during the process of comparison according to the earlier mentioned European Pat. No. EP-B 0 050 304. The output of the first AND-gate 14 is also connected with an input of the third AND-gate 16, the other input of which is connected to the selector R3 to receive a signal "a'". The output of the AND-gate 16 is connected with the drive control unit 6 of the respective elevator. The automatic holding circuit 13 can be formed by discrete logic elements or by the microprocessor of the microcomputer system 5 based on a program for any position of the second scanners R2 for the respective floor.

The mode of operation of the group control described in the preceding will be explained in more detail with the aid of the FIGS. 2 and 3. According to the initially cited European patent application No. EP-A 0 246 395, upon the entry of a call at a floor, a cost of operation calculation cycle is started for all elevators of the group and carried out for every one of the floors designated by the scanner R1. The costs of operation calculated in this manner are stored per floor in the cost memory RAM4. As is further known from the earlier cited publication, a cost comparison cycle is carried out after termination of the cost calculating cycle. In the comparison cycle, the operating costs stored in the cost memories RAM4 of all elevators of the floors designated in each case by the second scanner R2 are compared with each other and the respective newly entered call assigned to that car which exhibits the lowest operating costs.

On the entry of a call at a floor, for example entry at the floor E5 of the floor calls for the floors E7 and E9, an entry floor call for the floor E5 is stored in the floor call memory RAM1 as a "1". In the register RAM2.5, a pair of "1" signals representing the destination floor calls for the floors E7 and E9 are stored. Let us now assume that, at the first comparison after the call entry, the entry floor call E5 is assigned to the elevator A. It is obvious from the initially cited European patent application No. EP-A 0 246 395, that the calls E7 and E9 stored in the register RAM2.5 are transferred (dashed lines) as assigned calls into the first register RAM2' of the car call memory RAM2. During the first comparison of the floor E5, the second scanner R2 generates "a=1". With the clock signal "we=1"and "a=1" at the inputs of the AND-gate 24, a "1" is generated at the clock input "C" of the storage cell 22. If the NOT-gate 21 generates a "1" from the RAM1 storage cell 23 and with the assignment signal "Co=1"at the other input of the fourth AND-gate 17, a "1" is generated through the OR-gate 18 to the data input "D" of the storage cell 22 of the assignment memory RAM5 of the elevator A. The cell 22 is set and the data output becomes "Q=0".

Since at a stored call for floor E5 the data output of the respective storage cell 23 of the floor call memory RAM1 is set to "0" in a similar manner, the NOT-gates 20 and 21 set the output of the first AND-gate 14 and the associated one input of the first OR-gate 18 to "1". Let it furthermore be assumed that the call for floor E5 is assigned, still prior to transfer to the drive control of the elevator A, by a new comparison to the elevator B. In this case, an assignment signal "Co=0" is generated for the purpose of erasing the respective storage cell 22 of the assignment memory RAM5 for the elevator A, which assignment signal however cannot take effect, as the data input "D" of the storage cell 22 is held at "1" by way of the one input of the OR-gate 18. In this way, the floor call E5 assigned to elevator A in a first comparison cannot be assigned to any other elevator of the group.

If the assigned call lies in the direction of travel of the car 2 of elevator A and, if the selector R3 switches to the address of the floor E5, then "a'=1" whereby a signal "1" occurs at the output of the third AND-gate 16, which is interpreted by the drive control of the elevator A as a travel command to the floor E5.

On the first assignment of the floor E5 to the elevator A, the assignment signals "Co" for the other elevators of the group become "0". Thereby, the respective storage cell 23 of the floor call memory RAM1 is erased for those elevators when "we=1" and "a=1" at the inputs of the AND-gate 15. If, as described earlier, at a new comparison, the floor E5 is assigned to the elevator B, then for this elevator at "we=1", "a=1" and "Co=1", the respective storage cell 22 of the assignment memory RAM5 is not set, as the storage cell 23 of the floor call memory RAM1 was erased on assignment to the elevator A. Thus, the input of the first OR-gate 18 is connected with the output of the first AND-gate 14 as well as the one input of the fourth AND-gate 17 to be set to "0" to prevent the setting of the storage cell 22.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a group control for elevators having at least two elevator cars for serving a plurality of floors and for the immediate assignment of floor calls of destination including call registering devices arranged at the floors for entering floor calls for desired floors of destination, a floor call memory and an assignment memory for each elevator car which are connected with the call registering devices, each memory having a storage cell for each floor and wherein upon entry of a floor call, an entry floor call characterizing the input floor is stored in the associated storage cell of the floor call memory, load measuring devices provided in the cars of the elevator group, selectors assigned to each car of the group each indicating the floor of a possible stop for the associated car, first and second scanners assigned to each car of the group having for every floor at least one position, and a means for assigning the entered floor calls to the cars having for each car a computer and a comparison device, the computer calculating at each of the floors designated by the first scanner from parameters of the elevator and the load in the car, operating costs corresponding to the waiting times of the passengers, and the comparison device at every position of the second scanner comparing the operating costs of the cars with each other for assigning the floor call to the car with the lowest operating cost by placing the entry floor call into the associated storage cell of the assignment memory, the improvement comprising:

an automatic holding circuit for each car connected with the storage cells of the assignment memory and the floor call memory whereby, upon assignment of a floor call, the entry floor call remains stored until the assigned floor call has been served by the associated car.

2. The improvement according to claim 1 wherein said automatic holding circuit includes a first, second, third and fourth AND-gate each having two inputs, a first OR-gate having two inputs, a second OR-gate having three inputs and two NOT-gates, data outputs of the storage cells associated with a floor are connected through said NOT-gates with said inputs of said first AND-gate, an output of said first AND-gate is connected to one input of said first OR-gate and one input of said second OR-gate, an output of said first OR-gate is connected to a data input of the storage cell of the assignment memory, an output of said second OR-gate is connected to a data input of the storage cell of the floor call memory, said output of said first AND-gate is connected to one input of said second AND-gate, an output of said second AND-gate is connected to a second input of said second OR-gate, an output of said NOT-gate associated with the storage cell of the floor call memory is connected to one input of said fourth AND-gate, an output of said fourth AND-gate is connected to another input of said first OR-gate, another input of said fourth AND-gate and another input of said second AND-gate connected to receive an assignment signal, whereby an entry floor call is stored in the storage cell of the assignment memory in response to an entry floor call stored in the floor call memory and an assignment signal at the other input of the fourth AND-gate, and the entry floor call for the respective floor will be cancelled in the floor call memories of the other elevators, if no assignment signals are generated at the other inputs of the second AND-gates of the associated automatic holding circuits.

3. The improvement according to claim 2 wherein said output of said first AND-gate is connected with one input of said third AND-gate, another input of said third AND-gate is connected with the selector and an output of said third AND-gate is connected with the drive control of the respective elevator, whereby in the presence of an assigned floor call and the address generated by the selector of the respective floor, a travel command for said floor is generated at said output of said third AND-gate.

4. A group control for elevators having at least two cars for serving a plurality of floors, comprising:

call registering devices arranged at the floors for entering floor calls for desired floors of destination;

a floor call memory and an assignment memory connected with said call registering devices wherein upon entry of a call at a floor, an entry floor call representing the input floor is stored in said floor call memory;

selectors assigned to each car of the group each indicating the floor of a possible stop for the associated car;

first and second scanners assigned to each car of the group having for each floor at least one position;

a computer for each car connected to said call registering devices and said selector and said scanners for calculating at each of the floors designated by said first scanner from parameters of the elevator, operating costs corresponding to the waiting times of passengers;

a comparison device for each car connected to said computer for comparing at every position of said second scanner the operating costs of the cars with each other for assigning the floor call to the car with the lowest operating cost by placing said entry floor call into said assignment memory; and an automatic holding circuit connected to said assignment memory and said floor call memory for preventing the reassignment of the floor call to another car until the floor call has been served.

5. The group control according to claim 4 wherein said computer generates an assignment signal and said automatic holding circuit is responsive to said assignment signal and said entry floor call stored in said floor call memory for placing said entry floor call into said assignment memory.

6. The group control according to claim 5 wherein said automatic holding circuit is responsive to said assignment signal and the absence of said entry floor call in said floor call memory for preventing the placing of said entry floor call into said assignment memory.

* * * * *